US009915923B2

(12) United States Patent
Zaugg et al.

(10) Patent No.: US 9,915,923 B2
(45) Date of Patent: Mar. 13, 2018

(54) ARBOR OF A PIVOTING MOVABLE TIMEPIECE COMPONENT

(71) Applicant: Montres Breguet S.A., L'Abbaye (CH)

(72) Inventors: Alain Zaugg, Le Sentier (CH); Davide Sarchi, Renens (CH); Nakis Karapatis, Premier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/779,773

(22) PCT Filed: Mar. 17, 2014

(86) PCT No.: PCT/EP2014/055267
§ 371 (c)(1),
(2) Date: Sep. 24, 2015

(87) PCT Pub. No.: WO2014/154510
PCT Pub. Date: Oct. 2, 2014

(65) Prior Publication Data

US 2016/0085213 A1 Mar. 24, 2016

(30) Foreign Application Priority Data

Mar. 26, 2013 (EP) ..... 13161124

(51) Int. Cl.

| | |
|---|---|
| ***G04B 17/32*** | (2006.01) |
| ***G04B 15/14*** | (2006.01) |
| ***G04B 1/16*** | (2006.01) |
| ***G04C 3/04*** | (2006.01) |
| ***G04C 5/00*** | (2006.01) |

(52) U.S. Cl.
CPC ..... *G04B 17/32* (2013.01); *G04B 1/16* (2013.01); *G04B 15/14* (2013.01); *G04C 3/042* (2013.01); *G04C 5/00* (2013.01)

(58) Field of Classification Search
CPC ..... G04B 1/16; G04B 17/32; G04B 15/14
USPC ..... 368/322, 324–326
See application file for complete search history.

(56) References Cited

U.S. PATENT DOCUMENTS

| | | | | |
|---|---|---|---|---|
| 1,830,032 A * | 11/1931 | Kohler | G04B 17/32 368/325 |
| 2,131,797 A | 10/1938 | Dreyfus | |
| 3,605,401 A | 9/1971 | Reich | |
| 3,645,123 A * | 2/1972 | Auge | B21C 37/045 29/896.3 |

(Continued)

FOREIGN PATENT DOCUMENTS

| | | |
|---|---|---|
| CH | 705 655 | 4/2013 |
| DE | 1174518 | 7/1964 |

(Continued)

OTHER PUBLICATIONS

Suzuki, Seisaku, English Translation JP 04124246 A, originally published Apr. 24, 1992, full document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A one-piece arbor of a pivoting movable timepiece component, the one-piece arbor being made of one or more aligned parts. The one-piece arbor is magnetically inhomogeneous.

37 Claims, 3 Drawing Sheets

(56) References Cited

U.S. PATENT DOCUMENTS

| | | | | |
|---|---|---|---|---|
| 3,683,616 | A * | 8/1972 | Steinemann | G04B 43/007 368/293 |
| 3,934,406 | A * | 1/1976 | Bornand | G04B 17/32 368/177 |
| 9,372,473 | B2 * | 6/2016 | Zaugg | G04B 15/14 |
| 2001/0019780 | A1 * | 9/2001 | Obata | C25D 1/04 428/607 |
| 2003/0090962 | A1 | 5/2003 | Tu et al. | |
| 2007/0140065 | A1 * | 6/2007 | Levingston | B21F 35/04 368/127 |
| 2011/0164478 | A1 * | 7/2011 | Conus | G04B 31/004 368/324 |
| 2014/0198624 | A1 * | 7/2014 | Von Gruenigen | G04B 1/16 368/124 |
| 2014/0198625 | A1 * | 7/2014 | Von Gruenigen | G04B 1/16 368/124 |
| 2014/0247704 | A1 * | 9/2014 | Bertrand | G04B 17/063 368/177 |

FOREIGN PATENT DOCUMENTS

| | | | |
|---|---|---|---|
| FR | 1145049 | | 10/1957 |
| JP | 04124246 | A * | 4/1992 |
| WO | 01 77759 | | 10/2001 |
| WO | 2004 008258 | | 1/2004 |

OTHER PUBLICATIONS

Elgin Staffs for American Pocket Watches, Feb. 23, 2013, retrieved on Oct. 17, 2016 from <http://www.ofrei.com/page318.html>.*

International Search Report dated Jan. 5, 2015 in PCT/EP14/055267 Filed Mar. 17, 2014.

* cited by examiner

ARBOR OF A PIVOTING MOVABLE TIMEPIECE COMPONENT

CROSS-REFERENCE TO RELATED APPLICATIONS

This is a National Phase Application in the United States of International Patent Application No. PCT/EP 2014/055267 filed on Mar. 17, 2014 which claims priority on European Patent Application No. 13161124.6 filed on Mar. 26, 2013. The entire disclosures of the above patent applications are hereby incorporated by reference.

FIELD OF THE INVENTION

The invention concerns an arbor or staff of a pivoting movable timepiece component, said arbor being made of one or more aligned parts.

The invention also concerns a pivoting movable timepiece component including such an arbor.

The invention also concerns a timepiece mechanism including such an arbor and/or such a movable component, notably an escapement mechanism.

The invention also concerns a timepiece movement including such an arbor and/or such a movable component and/or such a mechanism.

The invention also concerns a timepiece, notably a watch, including such an arbor and/or such a movable component and/or such a mechanism and/or such a movement.

The invention concerns the field of timepiece mechanisms, particularly the field of regulating members, in particular for mechanical watches.

BACKGROUND OF THE INVENTION

The regulating member of a mechanical watch is formed by a harmonic oscillator, the sprung-balance, whose natural oscillation frequency mainly depends on the inertia of the balance wheel and on the elastic rigidity of the balance spring.

The oscillations of the sprung-balance, otherwise damped, are maintained by the impulses provided by an escapement generally formed by one or two pivoting components. In the case of the Swiss lever escapement, these pivoting components are the pallet lever and the escape wheel. The rate of the watch is determined by the frequency of the sprung-balance and by the disturbance caused by the impulse from the escapement, which generally slows down the natural oscillation of the sprung-balance and thus causes a losing rate.

The rate of the watch is thus disturbed by any phenomena that can impair the natural frequency of the sprung-balance and/or the time dependence of the impulse supplied by the escapement.

In particular, following temporary exposure of a mechanical watch to a magnetic field, rate defects (related to residual field effects) are generally observed. The origin of these defects is the permanent magnetization of the fixed ferromagnetic components of the movement or of the external watch parts and the permanent or temporary magnetization of the moving magnetic components forming part of the regulating member (sprung-balance) and/or of the escapement.

After exposure to the field, the magnetically charged or magnetically permeable moving components (balance wheel, balance spring, escapement) are subjected to a magnetostatic torque and/or to magnetostatic forces. In principle, these interactions modify the apparent rigidity of the sprung-balance, the dynamics of the moving escapement components and friction. These modifications produce a rate defect which may vary from several tens to several hundreds of seconds per day.

The interaction of the timepiece movement with the external field, during exposure, may also result in stopping the movement. In principle, there is no correlation between stopping under a field and the residual rate defect, because stopping under a field depends on the temporary, sub-field magnetization of the components (and thus on the permeability and saturation field of the components), whereas the residual rate defect depends on residual magnetization (and thus, mainly, on the coercive field of the components) which may be low even in the presence of high magnetic permeability.

Since the introduction of balance springs made of very weakly paramagnetic materials (for example silicon), the balance spring is no longer responsible for rate defects in watches. Any magnetic disturbances still observable for magnetization fields lower than 1.5 Tesla are thus due to the magnetization of the balance staff and to the magnetization of the movable escapement components.

The pallet lever body and the escape wheel can be manufactured in very weakly paramagnetic materials without this affecting their mechanical performance. Conversely, the arbors of the movable components require very good mechanical performance (good tribology, low fatigue) to permit optimum, constant pivoting over time, and it is thus preferable to manufacture them in hardened steel (typically 20AP carbon steel or similar). Such steels are materials that are sensitive to magnetic fields because they have a high saturation field combined with a high coercive field. The balance staff and arbors of the pallet lever and escape wheel are currently the most critical components as regards magnetic disturbances of the watch.

Patent Application D1 WO 2004/008258 A2 in the name of DETAR-PATEK PHILIPPE discloses a rotor-stator system composed of a wheel formed of a permanent magnet pre-magnetized in a fixed diametrical direction, and a solution for maintaining an oscillator. This document discloses an arbor producing an electromagnetic torque on which are mounted a rotor and a second pinion, which are not portions of the arbor but are mounted thereon, this arbor being a standard arbor with no specific magnetic properties.

Patent Application D2 U.S. Pat. No. 3,683,616 A in the name of STEINEMANN (STRAUMANN Institute) describes an escapement mechanism wherein all the parts mounted on the balance staff, and on the pallet lever, the escape wheel, and at least the main portion of the balance staff are manufactured from a very weakly paramagnetic material, having a magnetic permeability $\mu$ of less than 1.01. A variant concerns the application of a layer at least on the support points of the balance staff. In particular variants, some of the escapement components are formed exclusively from such a very weakly paramagnetic material. The balance spring may be made of such a very weakly paramagnetic material, or of an anti-ferromagnetic metal having a magnetic permeability $\mu$ of less than 1.01. In yet another variant, parts mounted on the balance staff are formed from a material selected from the group formed of Monel metal, silver, nickel, copper, a beryllium alloy and a copper-manganese alloy or a nickel alloy. In yet another variant, the pallet lever and the escape wheel are formed from a material selected from the group formed of silver, nickel, a copper-beryllium alloy and a nickel or manganese-copper alloy.

More particularly, the balance staff includes trunnions, and, with the exception of the bearing spindles, is entirely formed from a material having a magnetic permeability μ of less than 1.01. In another variant, the entire balance staff is formed from a material having a magnetic permeability μ of less than or equal to 1.01. The balance staff may also be formed of a hardened bronze.

Patent Application D3 CH 705 655 A2 in the name of ROLEX describes the minimisation of residual effects, i.e. of the difference in rate experienced by a watch subjected to variations in external magnetic fields. This minimisation is correlated, as a surprising effect, with the geometry of the balance staff. More particularly, this document describes an oscillator including a balance spring made of paramagnetic or diamagnetic material, and an assembled balance including an arbor on which are mounted a balance, a roller, a collet integral with the balance spring, and wherein, either the maximum diameter of the arbor is less than 3.5/2.5/2.0 times the minimum diameter of the arbor on which one of the other elements is mounted, or the maximum diameter of the arbor is less than 1.6/1.3 times the maximum diameter of the arbor on which one of the other elements is mounted. This document discloses an arbor having homogeneous intrinsic magnetic properties, in this case a highly ferromagnetic arbor. However, the roller is not an integral part of the arbor.

SUMMARY OF THE INVENTION

The invention proposes to limit magnetic interaction on the arbors of the movable components of a timepiece mechanism, inside a movement incorporated in a timepiece, notably a watch.

To this end, the invention concerns an arbor of a pivoting movable timepiece component, said arbor being made of one or more aligned parts, characterized in that said arbor is magnetically inhomogeneous.

According to a feature of the invention, said arbor is magnetically inhomogeneous with a variation in the intrinsic magnetic properties of said arbor radially with respect to said pivot axis.

According to a feature of the invention, said arbor is magnetically inhomogeneous with a variation in the intrinsic magnetic properties of said arbor radially with rotational symmetry with respect to said pivot axis.

The invention also concerns a pivoting movable timepiece component including such an arbor.

The invention also concerns a timepiece mechanism including such an arbor and/or such a movable component, notably an escapement mechanism.

The invention also concerns a timepiece movement including such an arbor and/or such a movable component and/or such a mechanism.

The invention also concerns a timepiece, notably a watch, including such an arbor and/or such a movable component and/or such a mechanism and/or such a movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
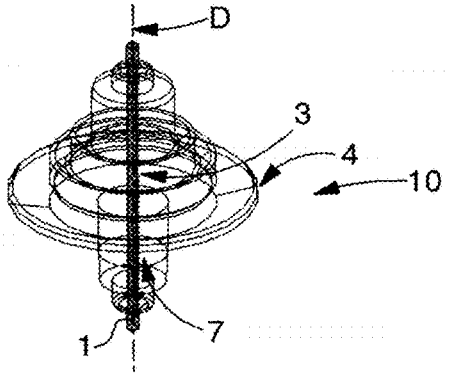
FIG. 1 shows, in the form of a three-dimensional diagram, a first variant of an arbor of a movable component according to the invention, including a central area with different intrinsic magnetic properties from those of the peripheral area that surrounds this central area centered on the pivot axis of the movable component.

It is an object of the invention to protect an oscillator from any magnetic disturbance.

The invention intends, in particular, to limit magnetic interaction on the arbors or staffs 1 of the movable pivoting components 10 of a timepiece mechanism 20 in a movement 30 incorporated in a timepiece 40, notably a watch, and in particular for the maintenance (escapement) and regulating (sprung balance) members which constitute a preferred application, on the balance staff, pallet staff and escape wheel arbor.

The invention is described here for this single application to the maintenance (escapement) and regulating (sprung balance) members. Those skilled in the art, watch designers, will know how to apply the invention to other mechanisms.

The invention permits can enable watches with a non-magnetic balance spring, pallet lever body and escape wheel to withstand, without stopping, magnetic fields on the order of 1 Tesla, without affecting mechanical performance (chronometry and ageing of the movable components).

The invention reduces the residual effect in watches with a non-magnetic balance spring, pallet lever body and escape wheel to less than one second per day.

The geometry of a balance staff is generally more complex than the geometry of the pallet staff, and that of the escape wheel arbor. Two alternative, non-limiting variants, exploiting the same principle are illustrated for the case of a balance staff. The application of these two variants to the case of a pallet staff and escape wheel, or to other movable pivoting components, will be evident to those skilled in the art.

By convention, in the present description an "axis" refers to a virtual geometrical element such as a pivot axis, and an "arbor" to a real mechanical element, formed of one or more parts. For example, a pair of pivots 2A and 2B aligned and arranged on either side of a median portion 6 of a movable component 10, to guide the pivoting thereof is also termed an "arbor".

In the explanation set out hereinafter, "magnetically permeable" materials are materials having a relative permeability of between 10 and 10000 such as steels, which have a relative permeability close to 100 for balance staffs, for example, or close to 4000 for the steels commonly used in electric circuits, or other alloys whose relative permeability reaches values of between 8000 and 10000.

"Magnetic materials", for example in the case of pole pieces, are materials able to be magnetized to have a remanent field of between 0.1 and 1.5 Tesla, such as for example "Neodymium Iron Boron" having a magnetic energy density Em close to 512 kJ/$m^3$ and giving a remanent field of 0.5 to 1.3 Tesla. A lower level of remanent field, towards the bottom part of the range, may be used in the event of combination, in a magnetization pair, of a magnetic material of this type with an opposing magnetically permeable component with high permeability, closer to 10000 in the range from 100 to 10000.

"Ferromagnetic" materials means materials whose characteristics are: saturation field Bs>0 at temperature T=23° C., coercive field Hc>0 at temperature T=23° C., maximum magnetic permeability $\mu_R$>2 at temperature T=23° C., Curie temperature Tc>60° C.

More particularly, "ferromagnetic" materials means materials whose characteristics are: saturation field Bs<0.5 T at temperature T=23° C., coercive field Hc<1,000 kA/m at temperature T=23° C., maximum magnetic permeability $p_R$<10 at temperature T=23° C., Curie temperature Tc>60° C.

The possibility of using ferromagnetic materials having specific characteristics simultaneously satisfies the requirement for mechanical strength, magnetic resistance and manufacturability of the components.

More particularly, "highly ferromagnetic" materials means materials whose characteristics are: saturation field Bs>1 T at temperature T=23° C., coercive field Hc>3,000 kA/m at temperature T=23° C., maximum magnetic permeability $\mu_R$>50 at temperature T=23° C., Curie temperature Tc>60° C.

"Paramagnetic" materials means materials with a relative permeability of between 1,0001 and 100, for example for spacer pieces inserted between a magnetic material and an opposing magnetically permeable component or between two magnetic materials, for example a spacer piece between a component and a pole piece. Weakly paramagnetic materials, having a magnetic permeability of between 1.01 and 2, can be used to implement the invention. Materials such as CoCr20Ni16Mo7, known in particular by the name of "PHYNOX®" or nickel-phosphorus NiP (either with a 12% concentration of phosphorus but hardened, or with a phosphorus concentration of less than 12%) are weakly paramagnetic and can therefore be used to implement the invention.

The utilisation of non-magnetic materials (magnetic permeability of less than 1.01) is very limiting, because these materials are either difficult to machine, or mechanically unsuitable for the required functions (and thus require a coating or a hardening process to make them ferromagnetic), which explains why the first watch resistant to 15,000 Gauss was only introduced in 2013. For example, non magnetic materials are: aluminium, gold, brass or similar.

"Diamagnetic" materials means materials with a relative magnetic permeability of less than 1 (negative magnetic susceptibility less than or equal to $10^{-5}$), such as graphite or graphene.

Finally, "soft magnetic" materials, as opposed to "non-magnetic" materials, particularly for shields, are materials exhibiting a high magnetic permeability but high saturation, since they are not required to be permanently magnetized: they must conduct the field as well as possible, so as to reduce the external field. These components can then also protect a magnetic system from external fields. These materials are preferably chosen to have a relative magnetic permeability of between 50 and 200 and with a saturation field of more than 500 A/m.

"Non-magnetic" materials are defined as materials with a relative magnetic permeability very slightly greater than 1, and less than 1.0001, typically like silicon, diamond, palladium and similar materials. These materials may generally be obtained via MEMS technology or the LIGA method.

Thus, the one-piece arbor 1 of pivoting movable timepiece component 10 is made of one or more parts 2 which are aligned on a pivot axis D.

It is specified that this arbor 1 is a pivoting axial element, which acts as a support for other components: roller, flange, collet, balance, but which is not formed by these other components, which are driven in, adhesive bonded, welded, brazed or driven onto the arbor, or held by other methods. The characteristics presented below concern only this arbor 1.

According to the invention, this one-piece arbor 1 is magnetically inhomogeneous.

Arbor 1 according to the invention has intrinsic magnetic properties (permeability, saturation field, coercive field, Curie temperature, dependent hysteresis curve) which are not uniform throughout its volume.

It should be recalled that magnetization does not form part of these intrinsic magnetic properties. The magnetization profile of such an arbor after magnetization does not depend exclusively on intrinsic magnetic properties, but depends notably on the source of the magnetic field which magnetized the arbor and the shape and size of said arbor. For example, the arbor may have non-uniform magnetization even if the intrinsic magnetic properties are uniform.

It should also be recalled that a component cannot become, for example, ferromagnetic after being subjected to a magnetic field: a material is either ferromagnetic, or paramagnetic, antiferromagnetic or diamagnetic. This characteristic can be modified by temperature but it cannot be modified by an external field. A distinction must be made between magnetization and the intrinsic magnetic properties of the material.

In a particular case, where the arbor is a bimaterial arbor, the invention proposes to use either paramagnetic materials, or ferromagnetic materials, having clearly defined intrinsic properties.

In particular, this one-piece arbor 1 is magnetically inhomogeneous with a variation in the intrinsic magnetic properties of one-piece arbor 1 either in the axial direction of pivot axis D of one-piece arbor 1, or radially with rotational symmetry with respect to pivot axis D, or both in the axial direction of pivot axis D and radially with rotational symmetry with respect to pivot axis D.

In a particular variant, one-piece arbor 1 is magnetically inhomogeneous with a variation in intrinsic magnetic properties radially with respect to pivot axis D.

In a preferred embodiment, this variation in the intrinsic magnetic properties of one-piece arbor 1 occurs radially with rotational symmetry with respect to pivot axis D.

An "inhomogeneous arbor in the radial direction" means here that the magnetic properties of the arbor vary in the radial direction, from the centre of the arbor towards the periphery (whereas the arbor may or may not be magnetically homogeneous in the axial direction).

Only the material located at the core of the arbor, in an area referred to below as central area 3, i.e. in proximity to pivot axis D, has a high saturation field (Bs>1 T), a maximum magnetic permeability $\mu_R$ greater than 50, and a coercive field Hc higher than 3 kA/m (all these properties are typical of the 20AP steel preferably used for the pivoting arbors for reasons of good mechanical performance). Naturally, if other materials are employed, these threshold values will have to be adapted by means of routine trials.

While the material at the periphery of the arbor, in an area referred to below as the peripheral area 4 is either weakly paramagnetic, or ferromagnetic with a low saturation field (Bs<0.5 T), a low maximum magnetic permeability $\mu_R$<10, and a low coercive field.

A diagram of this solution is shown in FIG. 1, which is a three dimensional diagram of the first variant. The one-piece balance staff 1 is composed of a highly ferromagnetic (grey) central area 3 and a paramagnetic or weakly ferromagnetic peripheral (white) area 4.

In this case, the two regions (highly ferromagnetic in central area 3 and weakly paramagnetic in peripheral area 4) are clearly separated by an abrupt interface area 7: the interface between the two regions 3 and 4 may, however, have a finite width, corresponding to a regular gradient of magnetic properties, without affecting the results. The highly ferromagnetic region in central area 3 at the core of one-piece staff 1 is preferably contained in a cylinder having a radius of less than 100 micrometres (and centred on pivot axis D) to achieve the desired performance.

In practice, the magnetic inhomogeneity described here can be obtained by combining two different materials (by brazing, welding or depositing one material on another), or, in the case where an alloy is used (for example carbon steel), by a heat treatment or electric or magnetic field treatment of all or part of the finished component. More particularly, heat and electromagnetic treatments are well suited for a treatment that is clearly defined in space.

Figure 2:
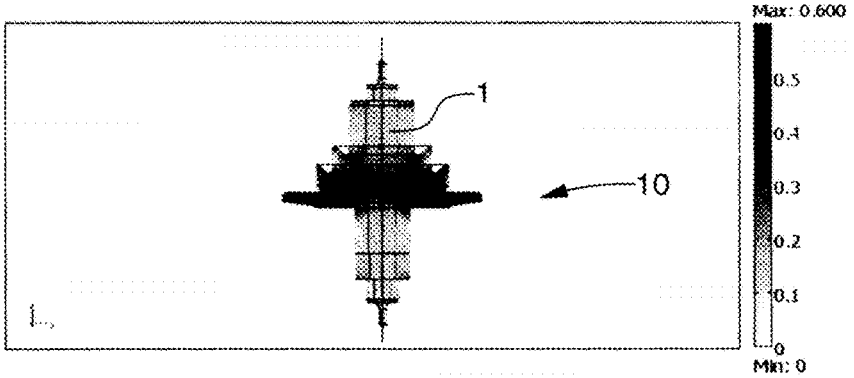
FIG. 2 shows a schematic view, in cross-section and with grey shading that is more intense the higher the remanent field, of a homogeneous arbor of the prior art after exposure to a magnetic field.

FIG. 2 shows the prior art, in the form of a conventional, one-piece, homogeneous balance staff 1, made of 20AP steel. This Figure illustrates the remanent field, after magnetization at 0.2 T. During magnetization, the staff is subjected to an external field of 0.2 T oriented in the direction orthogonal to the pivot axis, the entire volume of the staff is magnetized, its remanent field being comprised between 0.3 T and 0.6 T, as illustrated in FIG. 2 which shows:

in dark grey, the areas with a remanent field of 0.6 T;

in mid grey, the areas with a remanent field of around 0.2 to 0.4 T;

in very light grey or white, the areas with a remanent field of less than 0.2 T.

The magnetization is greater in correspondence with the maximum radius of the staff.

Figure 3:
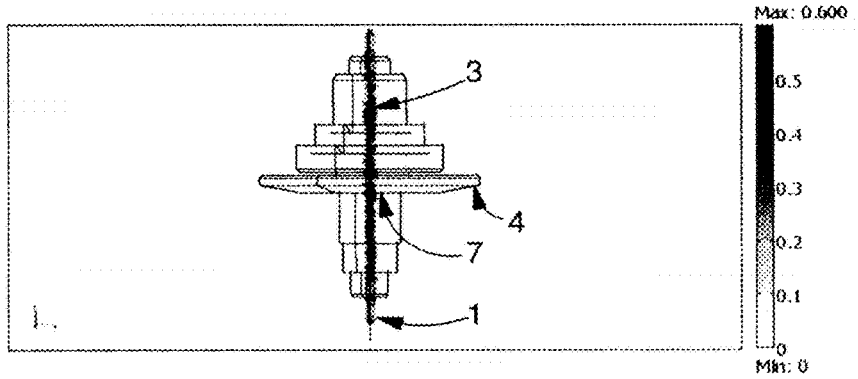
FIG. 3 shows a schematic view, similar to FIG. 2, of the arbor of FIG. 1 with a remanent field concentrated in its central axial area.
Figure 8:
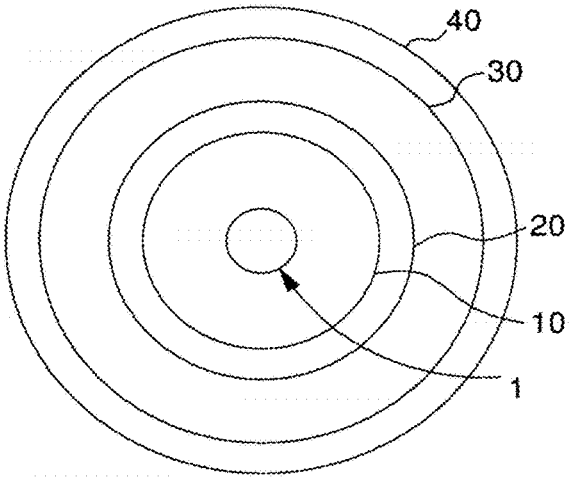
FIG. 8 shows block diagrams of a timepiece including a movement which includes a mechanism including a movable component equipped with an arbor according to the invention.

FIG. 3 shows the remanent field of a radially inhomogeneous one-piece balance staff 1 according to the first variant of the invention. This one-piece staff 1 has the same geometry as that of FIG. 2, but only the core, in central area 3, is made of 20 AP steel, while the periphery, in peripheral area 4, is weakly paramagnetic. The staff is subjected to an external field of 0.2 T oriented in the direction orthogonal to pivot axis D. The remanent field is approximately 0.4 T and concentrated in the core in central area 3.

When the timepiece is subjected to the action of an external magnetic field, during oscillation of the sprung balance, the magnetized balance staff is subjected to a magnetic torque that tends to orient it in the direction of the external field. The moment of this torque may be sufficiently high to stop the motion of the sprung balance.

As a result of the very distinct magnetization, the homogeneous staff of FIG. 2 is subjected to a magnetic torque, whose moment is more than 10 times greater than that applied to the inhomogeneous staff of FIG. 3. In fact the one-piece staff 1 according to the invention includes a remanent field area on a very small radius, whereas in the prior art, the high remanent field areas are actually in the areas of greatest radius.

The movement stops if the torque acting on the staff is greater than the return torque exerted by the balance spring for angles less than the lift angle, and than the maintaining torque applied by the pallet lever to the balance. These two torques, obtained using typical parameters, are compared to the magnetic torque acting on the homogeneous staff and on the inhomogeneous staff in the graph of FIG. 5.

Figure 4:
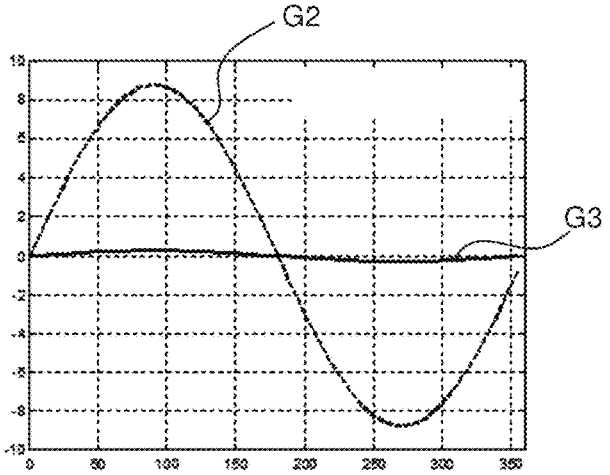
FIG. 4 illustrates, in the form of a graph, a comparison of the magnetic torques exerted on the two balance staff models of FIG. 2 and of FIG. 3, graph G2 corresponding to the homogeneous arbor of FIG. 2 is shown in a dash line, and graph G3 corresponding to the inhomogeneous arbor according to the invention is shown in a continuous line. On the abscissa is the angle in degrees, and on the ordinate the torque exerted on the balance in mN·mm.

FIG. 4 illustrates a comparison of the magnetic torques exerted on these two balance staff models: graph G2 corresponding to the homogeneous staff of FIG. 2 is shown in a dash line, and graph G3 corresponding to the one-piece inhomogeneous staff 1 according to the invention (first variant of FIG. 3 or second variant of FIG. 7 explained below) is shown in a continuous line. On the abscissa is the angle in degrees, and on the ordinate the torque exerted on the balance in mN·mm. In both cases, the torque varies sinusoidally with the angle of rotation of the sprung balance (here zero is set in an arbitrary manner).

The homogeneous staff of FIG. 2 is subjected to a much higher magnetic torque than the torque of the balance spring and than the maintaining torque. In this case, the sprung balance will thus be stopped with a field of less than 0.2 T.

The one-piece inhomogeneous staff 1 according to the first variant of the invention is subjected to a lower torque than the torque exerted by the balance spring in the lift angle (<30°) and than the maintaining torque. In this case, the sprung balance will not be stopped under a field of 0.2 T.

Figure 5:
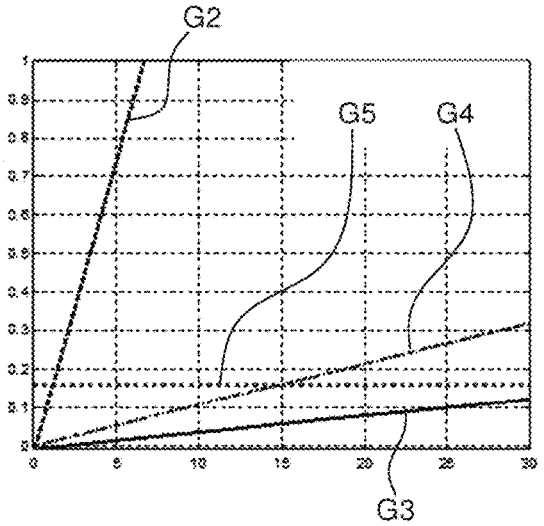
FIG. 5 illustrates, in the form of a graph, a comparison of the magnetic torques exerted on these two balance staff models of FIG. 2 and of FIG. 3, compared to the return torque of the balance spring and to the torque applied to the balance by the pallet lever. Graph G2 corresponding to the homogeneous arbor of FIG. 2 is shown in dash lines, and graph G3 corresponding to the inhomogeneous arbor or staff according to the invention is shown in a continuous line. The dot and dash line G4 represents the return torque exerted by the balance spring. The maintaining torque, applied to the balance by the pallet lever, is represented in the form of a horizontal dotted line G5.

FIG. 5 illustrates a comparison of the magnetic torques on a homogeneous balance staff according to the prior art, and inhomogeneous staff according to the invention (first variant, or second variant explained below), imposed by an external field of 0.2 T, compared to the return torque of the balance spring and to the torque applied to the balance by the pallet lever. Like FIG. 4, FIG. 5 illustrates a comparison, over a small angular amplitude, of the magnetic torques exerted on these two balance staff models: graph G2 corresponding to the homogeneous staff is shown in a dash line, and graph G3 corresponding to the inhomogeneous staff is shown in a continuous line. The dot and dash line G4 represents the return torque exerted by the balance spring. The maintaining torque, applied to the balance by the pallet lever, is represented in the form of a horizontal dotted line G5.

Following magnetization of the watch, the one-piece staff 1 of the balance 10 is immersed in the magnetic field created by the fixed ferromagnetic components of movement 30 and/or of the timepiece 40 of which it forms part. One-piece staff 1 is then subjected to a similar torque to that which is shown in FIG. 4 but of lower moment. This disturbing torque is responsible for the residual rate defect. A movement fitted with an inhomogeneous one-piece staff 1 according to the first variant of the invention thus suffers from a rate defect which is between 3 and 10 times lower than that affecting a movement fitted with a conventional homogeneous staff.

The second variant of the invention concerns a staff which is inhomogeneous in the axial direction, parallel to the pivot axis of the staff.

In this case, the magnetic properties are inhomogeneous in the axial direction. The ends 2 of the one-piece staff 1 formed by pivots 2A and 2B, which must have optimal mechanical properties, are generally made of magnetic materials, while the median portion 6 of one-piece staff 1 is made of weakly paramagnetic material.

The cumulative length (in the axial direction) of the magnetic parts of one-piece staff 1 is advantageously less than one third of the total length of one-piece staff 1.

The difference in length between the magnetic parts is advantageously maintained less than 10%.

Figure 6:
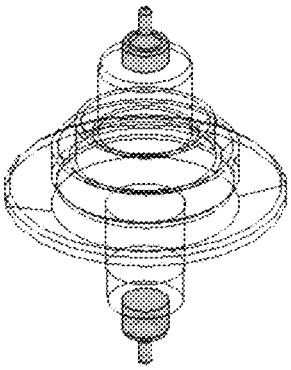
FIG. 6 shows, in a similar manner to FIG. 1, a second variant of an arbor of a movable component according to the invention, including a median portion having different intrinsic magnetic properties from those of the two end areas that surround this median portion, on either side in the direction of the pivot axis of the movable component.

This second variant is shown schematically in FIG. 6, in which preferably only pivots 2A and 2B are made of ferromagnetic material.

The one-piece staff 1 of FIG. 6 includes, in the direction of pivot axis D, a median portion 6 surrounded on either side by two end areas 8. Only these end areas 8, preferably made with steel pivots, have a high saturation field with a value Bs higher than 1 T, a maximum magnetic permeability $\mu_R$ greater than 50 and a coercive field Hc higher than 3 kA/m. Whereas the material in median portion 6 is either weakly paramagnetic or ferromagnetic with a low saturation field Bs having a value of less than 0.5 T, a low maximum magnetic permeability $\mu_R$ of less than 10 and a low coercive field.

Specifically, in the embodiment type shown in FIG. 6, advantageous choices are possible:

- a paramagnetic median portion with $2>\mu>1.01$
- a non-magnetic median portion (as defined above)
- a paramagnetic median portion with $\mu<1.01$, and whose volume is less than the volume of the ferromagnetic portion, provided that the volume of the ferromagnetic portion is lower than a value $$X=\delta_m(C_{ech}+k\,\theta_l)/(b\,\mu_0 B_s H\,\theta_l) \quad (1)$$

where, for an arbor 1 which is a balance staff of a sprung balance assembly of a watch movement, X is a function of the desired maximum relative rate defect $\delta_m$ (generally $\delta_m=10^{-4}$) of the rigidity of the balance spring k, of the maximum maintaining torque of the balance $C_{ech}$, of the lift angle $\theta_l$, of vacuum permeability $\mu_0$, of saturation field $B_s$ of the ferromagnetic portion of the staff and of the maximum magnetization field H that the watch is intended to withstand without exceeding the relative defect $\delta_m$. The coefficient b is a factor, on the order of the unit if the other quantities are expressed in the International System of Units, and which depends on the geometric shape of the staff. X is typically comprised between 0.1 $mm^3$ and 1 $mm^3$. As in the first variant, the remanent field is lower (and more localised) than in the case of a homogeneous staff of FIG. 2 as shown in FIG. 7.

Figure 7:
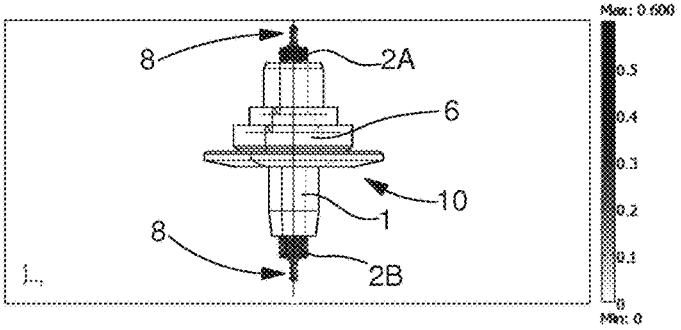
FIG. 7 shows, in a similar manner to FIG. 3, the distribution of the remanent field on the arbor of FIG. 6, with a concentrated remanent field on its two axial end areas.

FIG. 7 shows the remanent field, after magnetization at 0.2 T, of a one-piece inhomogeneous balance staff 1 according to the second variant of the invention. The pivots are made of 20 AP steel. Median portion 6 is weakly paramagnetic.

The torque acting on one-piece staff 1 in this case is equivalent to that obtained in the first variant (FIG. 4 and FIG. 5).

In practice, as in the first variant, the desired magnetic inhomogeneity can be obtained by combining two different materials (by brazing, welding or depositing one material on another) or, in the case where an alloy is used (for example carbon steel), by heat treatment or electric or magnetic field treatment of all or part of the finished component.

It is also possible to mix the first and second variants, one-piece staff 1 is then magnetically inhomogeneous with a variation of its intrinsic magnetic properties both in the axial direction of pivot axis D and radially with respect to pivot axis D.

In both of these variants, the invention is easy and inexpensive to produce, since, in practice, the desired result can be obtained with a simple bimaterial embodiment. For example, an implementation according to the first variant, with a balance rim forming peripheral area 4 which is made, depending on the required inertia, of aluminium, gold, brass or similar, while central area 3 is made in the form of a 20AP steel bar or similar, produces a low inertia balance with a light alloy rim, notably aluminium, which is easy to machine and to pierce on both sides, and a drawn or wire drawn or bar turned steel core, with a diameter of less than 100 micrometres. Similarly, a balance according to the second variant and with very low inertia includes a machined aluminium alloy median portion 6 including, at its axial ends, two housings for driving in steel pivots 2A and 2B.

The following bimaterial embodiments give good results, despite the contrary teachings of the literature:

- highly ferromagnetic/weakly ferromagnetic;
- highly ferromagnetic/weakly paramagnetic with $2>\mu>1.01$, despite the preconceived notion that such a material cannot be used for this type of design. In particular, "PHYNOX" falls within this range of materials;
- situation where the paramagnetic portion (mass) of the staff is not the main portion (mass). Solutions where the ferromagnetic portion is dominant are efficient and included in the present Application: the maximum (absolute) dimensions of the highly ferromagnetic portion are determined exclusively by the rigidity of the balance spring and the maintaining torque (see equation (1)).

Figure 9:
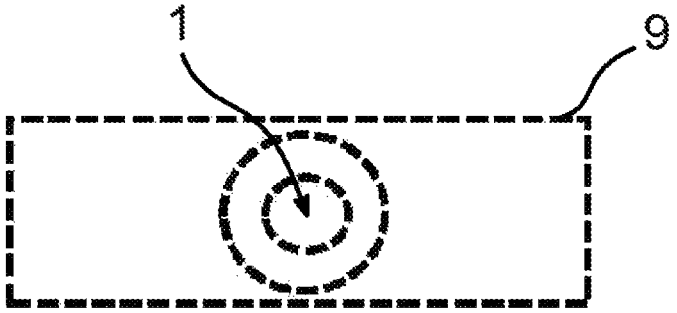
FIG. 9 shows schematic representation of a non-limiting illustrative example of an inscribing rectangle of a protruding portion of an arbor from an end view in the direction of the pivot axis.

In a particular embodiment shown in FIG. 9 for example, staff 1 includes at least one protruding portion having a larger radius around pivot axis D, and at least said protruding portion is delimited, on either side of said pivot axis D, by two surfaces, which are symmetrical with respect to said pivot axis D, and which define, in projection on a plane perpendicular to said pivot axis D, a profile inscribed in a rectangle 9, whose length to width ratio defines an aspect ratio which is greater than or equal to 2, the direction of said length defining a main axis DP.

The invention also concerns a pivoting movable timepiece component 10 including a one-piece arbor or staff 1 according to the invention.

The invention also concerns a timepiece mechanism 20 including such a one-piece arbor or staff 1 and/or such a movable component 10, notably an escapement mechanism.

In the particular embodiment set out above and wherein staff 1 includes at least one such particular protruding portion, this timepiece mechanism 20 includes a movable component 10 oscillating around a rest position defined by a rest plane passing through a pivot axis D, said movable component 10 being returned to a rest position by elastic return means. This movable component 10 includes one such staff 1 which includes one such particular protruding portion, said staff 1 is made of steel, and said main axis DP of said staff 1, in the plane orthogonal to said staff, occupies a determined angular position with respect to said rest plane, in said rest position of said movable component 10, said mechanism 20 having a preferred direction of magnetization DA, which is substantially orthogonal to said main axis DP of said staff 1 in said rest position.

The invention also concerns a timepiece movement 30 including one such one-piece arbor or staff 1 and/or one such movable component 10 and/or one such mechanism 20.

The invention also concerns a timepiece 40, particularly a watch, including at least one such one-piece arbor or staff 1 and/or one such movable component 10 and/or one such mechanism 20 and/or one such movement 30.

In summary, the invention does not require any pre-magnetized permanent magnets, or any magnetic wheels, but only magnetically passive (paramagnetic or ferromagnetic) arbors or staffs.

The object of the invention is not to provide a solution for maintaining the oscillator, but to protect the oscillator from any magnetic disturbance.

The invention, in one or other of its variants, has significant advantages:

- increased sub field stopping field intensity for watches with a non-magnetic balance spring, pallet lever body and escape wheel; this means that a watch would have to be subjected to much higher magnetic fields than those encountered by the user in normal life before there is a risk of a disturbance liable to cause the movement to stop;
- reduced residual effect for watches with a non-magnetic balance spring, pallet lever body and escape wheel;
- mechanical performance identical to state of the art watches, since the tribological contact surfaces continue to be made from materials validated for these applications.

The invention claimed is:

1. A one-piece arbor or staff of a pivoting movable timepiece component, the one-piece arbor comprising:

- one or more aligned parts that the one-piece arbor is made in,
- wherein the one-piece arbor is magnetically inhomogeneous after being magnetized from an external magnetic field source, and has intrinsic magnetic properties, which are: permeability, saturation field, coercive field, Curie temperature, and dependent hysteresis curve, which are not uniform throughout a volume of the one-piece arbor, and
- wherein a core of the one-piece arbor and a body of the one-piece arbor other than the core cause the one-piece arbor to be magnetically inhomogeneous and to have the intrinsic magnetic properties be not uniform throughout the volume of the one-piece arbor.

2. The one-piece arbor according to claim 1, wherein the one-piece arbor is magnetically inhomogeneous, with a variation in the intrinsic magnetic properties of the one-piece arbor either in an axial direction of a pivot axis of the one-piece arbor, or radially with respect to the pivot axis, or both in the axial direction of the pivot axis of the one-piece arbor and radially with rotational symmetry with respect to the pivot axis.

3. The one-piece arbor according to claim 1, wherein the one-piece arbor is magnetically inhomogeneous with a variation in the intrinsic magnetic properties of the one-piece arbor radially with respect to a pivot axis of the one-piece arbor.

4. The one-piece arbor according to claim 3, wherein the one-piece arbor is magnetically inhomogeneous with a variation in the intrinsic magnetic properties of the one-piece arbor radially with rotational symmetry with respect to the pivot axis.

5. The one-piece arbor according to claim 3, wherein only material located at the core of the one-piece arbor, in a central area in proximity to the pivot axis of the one-piece arbor made of steel, has a high saturation field having a value greater than 1 T, a maximum magnetic permeability greater than 50, and a coercive field higher than 3 kA/m, whereas a material in a peripheral area of the one-piece arbor is weakly paramagnetic.

6. The one-piece arbor according to claim 3, wherein only a material located at the core of the one-piece arbor, in a central area in proximity to the pivot axis of the one-piece arbor made of steel, has a high saturation field having a value greater than 1 T, a maximum magnetic permeability greater than 50, and a coercive field higher than 3 kA/m, whereas material in a peripheral area of the one-piece arbor is ferromagnetic with a low saturation field having a value of less than 0.5 T, a low maximum magnetic permeability of less than 10, and a low coercive field.

7. The one-piece arbor according to claim 6, wherein a highly ferromagnetic region of the central area at the core of the one-piece arbor is contained in a cylinder having a radius less than 100 micrometers and centered on the pivot axis of the one-piece arbor.

8. The one-piece arbor according to claim 3, wherein a material in a peripheral area of the one-piece arbor is weakly paramagnetic, with a low saturation field having a value of less than 0.5 T, a low maximum magnetic permeability of less than 10, and a low coercive field.

9. The one-piece arbor according to claim 3, wherein a material in a peripheral area of the one-piece arbor is ferromagnetic, with a low saturation field having a value of less than 0.5 T, a low maximum magnetic permeability of less than 10, and a low coercive field.

10. The one-piece arbor according to claim 1, wherein the one-piece arbor is magnetically inhomogeneous with a variation in the intrinsic magnetic properties of the one-piece arbor in an axial direction of a pivot axis of the one-piece arbor.

11. The one-piece arbor according to claim 10, wherein the one-piece arbor includes, in a direction of the pivot axis, a median portion surrounded on either side by two end areas, and only the end areas, made of steel, have a high saturation field having a value greater than 1 T, a maximum magnetic permeability greater than 50, and a coercive field higher than 3 kA/m, whereas material in the median portion of the one-piece arbor is weakly paramagnetic.

12. The one-piece arbor according to claim 10, wherein the one-piece arbor includes, in a direction of the pivot axis, a median portion surrounded on either side by two end areas, and wherein only the end areas, made of steel, have a high saturation field having a value greater than 1 T, a maximum magnetic permeability greater than 50, and a coercive field higher than 3 kA/m, whereas material in the median portion of the one-piece arbor is ferromagnetic with a low saturation field having a value of less than 0.5 T, a low maximum magnetic permeability of less than 10, and a low coercive field.

13. The one-piece arbor according to claim 1, wherein the one-piece arbor is magnetically inhomogeneous with a variation in the intrinsic magnetic properties of the one-piece arbor both in an axial direction of a pivot axis of the one-piece arbor and radially with rotational symmetry with respect to the pivot axis.

14. The one-piece arbor according to claim 1, wherein the one-piece arbor includes at least either a paramagnetic portion with a magnetic permeability between 1.01 and 2, or a ferromagnetic portion.

15. The one-piece arbor according to claim 14, wherein the one-piece arbor includes at least one paramagnetic portion with a magnetic permeability between 1.01 and 2.

16. The one-piece arbor according to claim 15, wherein the one-piece arbor includes at least one median paramagnetic portion with a magnetic permeability between 1.01 and 2.

17. The one-piece arbor according to claim 14, wherein the one-piece arbor includes at least one weakly ferromagnetic portion, with saturation field Bs<0.5 T at temperature T=23° C., coercive field Hc<1,000 kA/m at temperature T=23° C., maximum magnetic permeability $\mu_R$<10 at temperature T=23° C., and Curie temperature Tc>60° C.

18. The one-piece arbor according to claim 14, wherein the one-piece arbor includes at least one paramagnetic portion, with a maximum magnetic permeability between 1.01 and 2 and at least one weakly ferromagnetic portion, with saturation field Bs<0.5 T at temperature T=23° C., coercive field Hc<1,000 kA/m at temperature T=23° C., maximum magnetic permeability $\mu_R$ <10 at temperature T=23° C., and Curie temperature Tc>60° C.

19. The one-piece arbor according to claim 1, wherein the one-piece arbor includes at least one portion made of CoCr20Ni16Mo7.

20. The one-piece arbor according to claim 1, wherein the one-piece arbor includes at least one portion made of NiP.

21. The one-piece arbor according to claim 1, wherein the one-piece arbor is an at least bimaterial arbor and includes at least one portion made of highly ferromagnetic material and at least one portion made of weakly ferromagnetic material.

22. The one-piece arbor according to claim 1, wherein the one-piece arbor is an at least bimaterial arbor and includes at least one portion made of highly ferromagnetic material and at least one portion made of weakly paramagnetic material with a magnetic permeability between 1.01 and 2.

23. The one-piece arbor according to claim 1, wherein the one-piece arbor is an at least bimaterial arbor and includes one portion made of paramagnetic material whose mass is lower than that of another portion made of ferromagnetic material.

24. The one-piece arbor according to claim 23, wherein the one-piece arbor is a balance staff of a sprung balance assembly of a watch movement, and a volume of the another portion made of ferromagnetic material is less than a value that is between 0.1 $mm^3$ and 1 $mm^3$.

25. The one-piece arbor according to claim 1, wherein the one-piece arbor is made of only one material and is magnetically inhomogeneous as a result of a manufacturing process.

26. The one-piece arbor according to claim 1, wherein the magnetic inhomogeneity is obtained by combining two different materials by brazing, welding, or depositing one material on another.

27. The one-piece arbor according to claim 1, wherein the magnetic inhomogeneity is obtained by using an alloy subjected to a heat treatment or to action of an electric or magnetic field on all or part of the one-piece arbor or of a movable component.

28. The one-piece arbor according to claim 1, wherein the one-piece arbor is a balance staff.

29. The one-piece arbor according to claim 1, wherein the one-piece arbor includes at least one protruding portion having a larger radius around a pivot axis of the one-piece arbor, and at least the protruding portion is delimited, on either side of the pivot axis, by two surfaces, which are symmetrical with respect to the pivot axis, and which define, in projection on a plane perpendicular to the pivot axis, a profile inscribed in a rectangle, whose length to width ratio defines an aspect ratio which is greater than or equal to 2, a direction of a length defining a main axis.

30. A movable timepiece component comprising at least one one-piece arbor according to claim 1.

31. A timepiece mechanism comprising one one-piece arbor according to claim 1, wherein the timepiece mechanism is an escapement mechanism.

32. The timepiece mechanism according to claim 31, comprising one movable component oscillating about a rest position defined by a rest plane passing through a pivot axis, the movable component being returned to a rest position by an elastic return mechanism, wherein the movable component includes the one-piece arbor, the one-piece arbor being made of steel, and a main axis of the one-piece arbor, in a plane orthogonal to the one-piece arbor, occupies a determined angular position with respect to a rest plane of the movable component, in a rest position of the movable component, the timepiece mechanism having a preferred direction of magnetization which is substantially orthogonal to the main axis of the one-piece arbor in the rest position.

33. A timepiece movement comprising one one-piece arbor according to claim 1.

34. A timepiece or watch, comprising one one-piece arbor according to claim 1.

35. The one-piece arbor according to claim 1, wherein the one-piece arbor is made entirely of at least one magnetic material.

36. The one-piece arbor according to claim 1, wherein the one-piece arbor is made of at least one magnetic material that is a dominant portion of a mass of the one-piece arbor.

37. The one-piece arbor according to claim 1, wherein the one-piece arbor does not include any non-magnetic material.

* * * * *